US008499964B1

(12) United States Patent
Allick

(10) Patent No.: US 8,499,964 B1
(45) Date of Patent: Aug. 6, 2013

(54) SNOW COLLECTOR DEVICE

(76) Inventor: Stephen Allick, Brooklyn, NY (US)

( * ) Notice: Subject to any disclaimer, the term of this patent is extended or adjusted under 35 U.S.C. 154(b) by 166 days.

(21) Appl. No.: 13/083,102

(22) Filed: Apr. 8, 2011

(51) Int. Cl.

| | |
|---|---|
| ***B65D 6/28*** | (2006.01) |
| ***B65D 6/40*** | (2006.01) |
| ***B65D 8/04*** | (2006.01) |
| ***B65D 8/18*** | (2006.01) |
| ***B65D 25/32*** | (2006.01) |
| ***B65D 19/00*** | (2006.01) |

(52) U.S. Cl.
USPC ..... 220/773; 220/623; 220/661; 220/669; 220/676; 220/908; 206/386; 206/595

(58) Field of Classification Search
USPC ..... 220/623, 661, 669, 675, 676, 908, 220/773; 206/386, 595, 811, 818; 37/196, 37/197; 383/4
See application file for complete search history.

(56) References Cited

U.S. PATENT DOCUMENTS

| | | | | |
|---|---|---|---|---|
| 3,504,846 | A * | 4/1970 | Barnhill | 232/43.2 |
| 4,793,519 | A * | 12/1988 | Voorhies, Jr. | 206/386 |
| 5,367,278 | A * | 11/1994 | Yoshikawa | 335/285 |
| 5,715,968 | A * | 2/1998 | Fink et al. | 220/669 |
| 5,984,134 | A * | 11/1999 | Mario | 220/661 |
| 6,176,455 | B1 * | 1/2001 | Ma | 248/101 |
| 7,132,045 | B1 | 11/2006 | Trangsrud | |
| 2007/0163156 | A1 | 7/2007 | Orr | |
| 2007/0289667 | A1 | 12/2007 | Hennessy | |
| 2010/0008601 | A1 | 1/2010 | Prudencio | |

* cited by examiner

*Primary Examiner* — Anthony Stashick
*Assistant Examiner* — Madison L Poos

(57) ABSTRACT

A snow collector device for the collection and disposal of snow before the snow collects on a driveway, sidewalk, or parking lot, including a storage container having concave first and second walls to prevent the snow compaction against the storage container and having an internal cavity accessed through an open top end for receiving snow therein; an access door disposed on a front wall, an a strap pivotally attached to the front and rear walls; and magnets on the rear wall to secure the storage container to a vehicle exterior. A flag having an elongated post is vertically disposed on the top end perimeter at each corner thereof for high visibility. A large version is mounted to a pallet configured for lifting by a forklift to dispose of snow collected in the storage container.

9 Claims, 5 Drawing Sheets

SNOW COLLECTOR DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of snow collection devices are known in the prior art. However, what is needed is a snow collector device including a storage container having concave first and second walls to prevent the snow compaction against the storage container and having an internal cavity accessed through an open top end for receiving snow therein; an access door disposed on a front wall, an a strap pivotally attached to the front and rear walls; and magnets on the rear wall to secure the storage container to a vehicle exterior. A flag having an elongated post is vertically disposed on the top end perimeter for high visibility. A large version is mounted to a pallet configured for lifting by a forklift to dispose of snow collected in the storage container.

FIELD OF THE INVENTION

The present invention relates to snow disposal devices, and more particularly, to a snow collector device including a storage container having concave first and second walls and an internal cavity accessed through an open top end for receiving snow therein as well as an access door disposed on a front wall, and a strap pivotally attached to the front and rear walls with optional magnets on the rear wall to secure the storage container to a vehicle exterior and flags vertically disposed on the top end perimeter for high visibility; and a large version mounted to a pallet configured for lifting by a forklift to dispose of snow collected in the storage container.

SUMMARY OF THE INVENTION

The general purpose of the present snow collector device, described subsequently in greater detail, is to provide a snow collector device which has many novel features that result in a snow collector device which is not anticipated, rendered obvious, suggested, or even implied by prior art, either alone or in combination thereof.

To accomplish this, the present snow collector device includes a storage container that has a bottom wall, an open top end, a front wall, a rear wall, with each of the front and rear walls having a concave first side and a concave second side. A continuous perimeter is disposed around the top end. The storage container also has a concave first wall and an opposing concave second wall and an internal cavity for removably receiving snow therein. The concave configuration of the first and second walls permits an overhang of the perimeter over each of the first and second walls, thereby reducing the compacting of snow around the storage container which, in turn, makes the lifting of the container easier than with snow compacted around the storage container. An access door, centrally disposed on the front wall, has pull member for opening the access door. A sturdy strap, having opposing outer ends pivotally attached to the respective front wall and rear wall to move the strap aside during snow collection, is configured for lifting the storage container when filled with snow.

The storage container is configured for placement on a ground surface, such as a driveway, a sidewalk, and in the case of a large version on a parking lot, for the collection of snow within the internal cavity of the storage container. One size of the storage container has a height in a range of 15 inches to 24 inches, a length in a range of 18 inches to 36 inches, and a width in a range of 12 inches to 20 inches to provide for optimal weight for hand-lifting the storage container filled with snow in order to dispose of snow contained therein. A large-size storage container has a height of approximately 36, a length of approximately 36 inches, and a width of approximately 36 inches. Magnets are optionally disposed on the rear wall to permit the storage container to be secured to a vehicle exterior for the collection of snow before the snow collects on the portion of the vehicle exterior covered by the storage container. The large version of the present device is mounted to a pallet configured for lifting by a forklift to dispose of snow collected in the storage container. A flag, vertically disposed on each corner of the perimeter and having an elongated support post, is configured for high visibility in snowy conditions, thus allowing location of the storage container, including deep snow conditions, thereby preventing accidental encounters with and damage to the storage container as well as injury to an individual who is unaware of the presence of the storage container.

Thus has been broadly outlined the more important features of the present snow collector device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
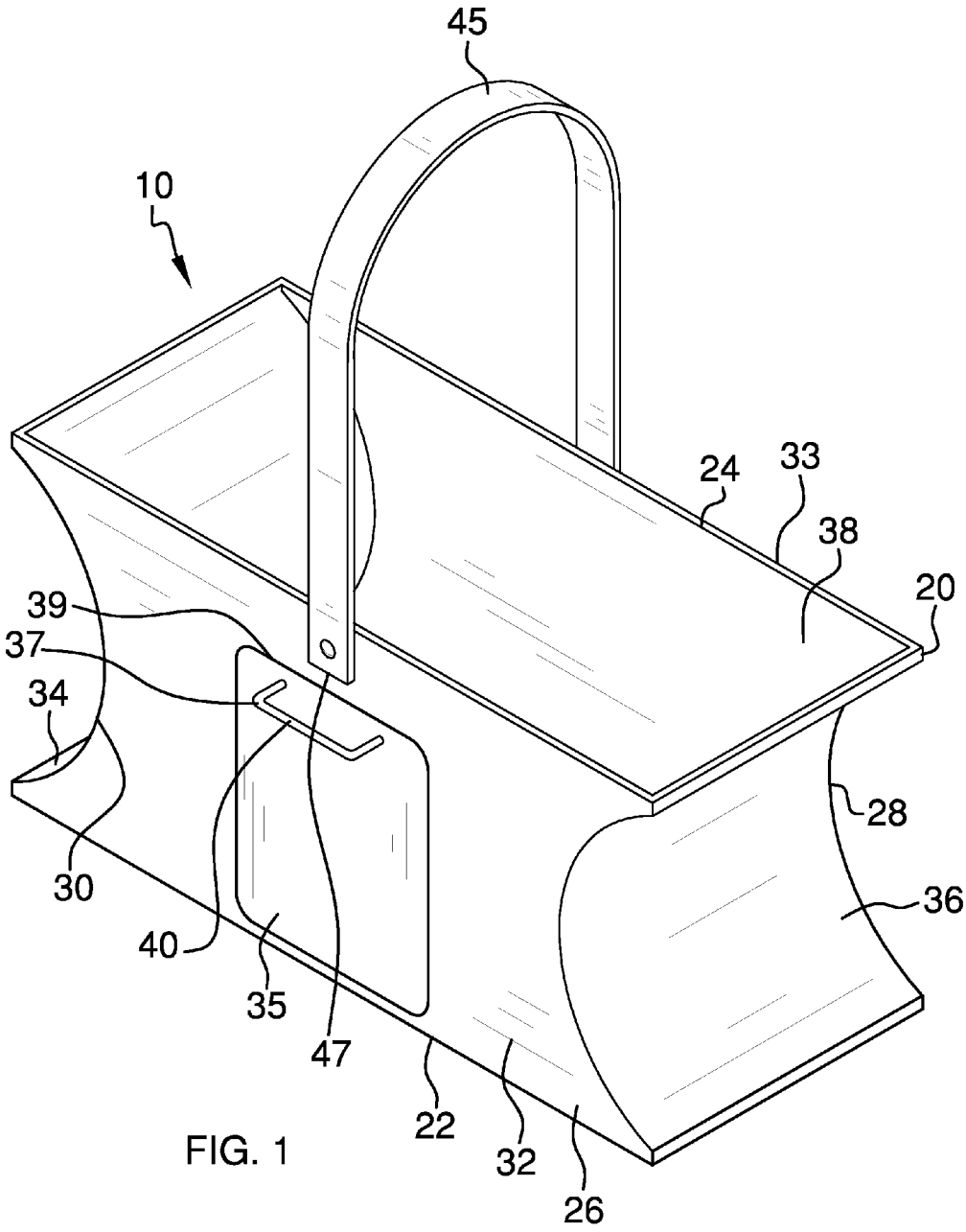
FIG. 1 is a front isometric view.
Figure 2:
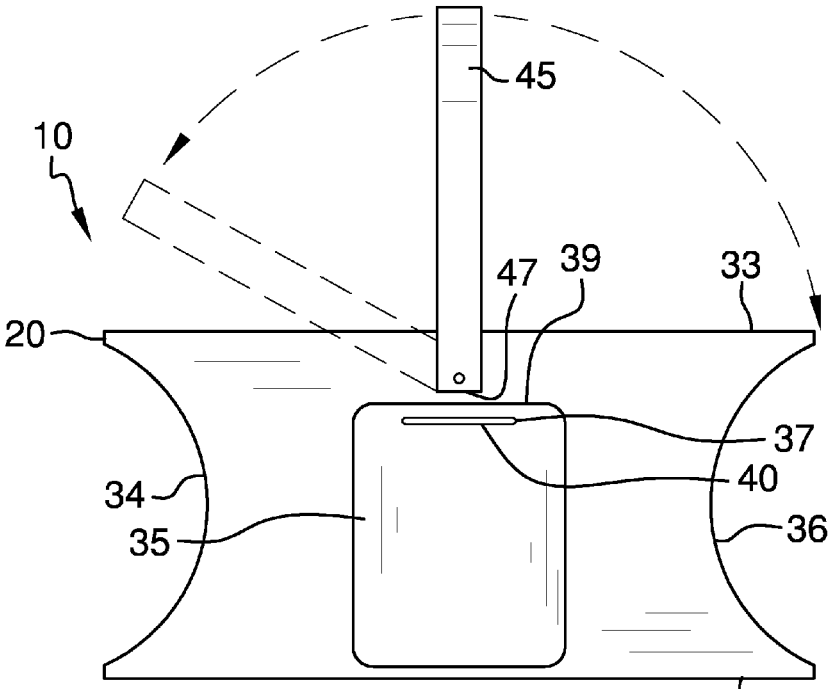
FIG. 2 is a front elevation view.
Figure 3:
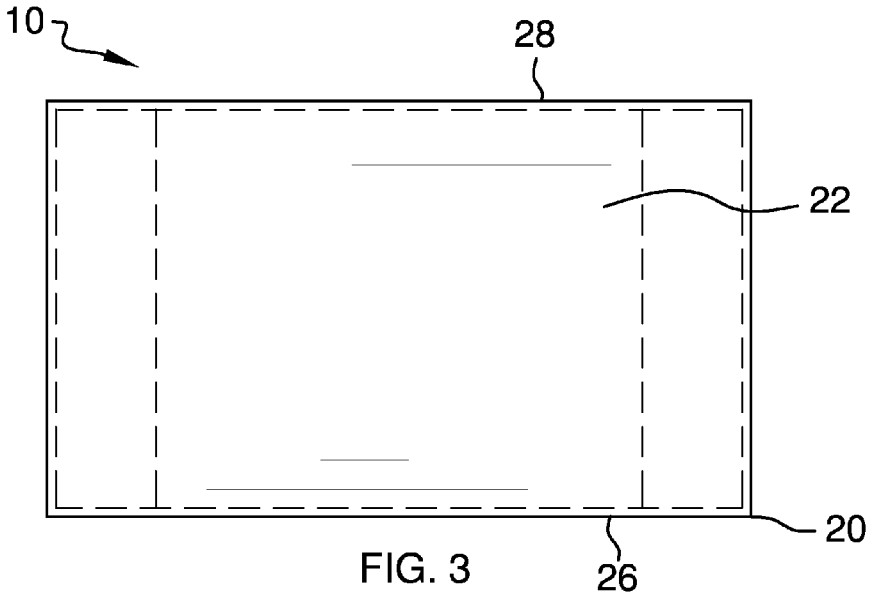
FIG. 3 is a bottom plan view.
Figure 4:
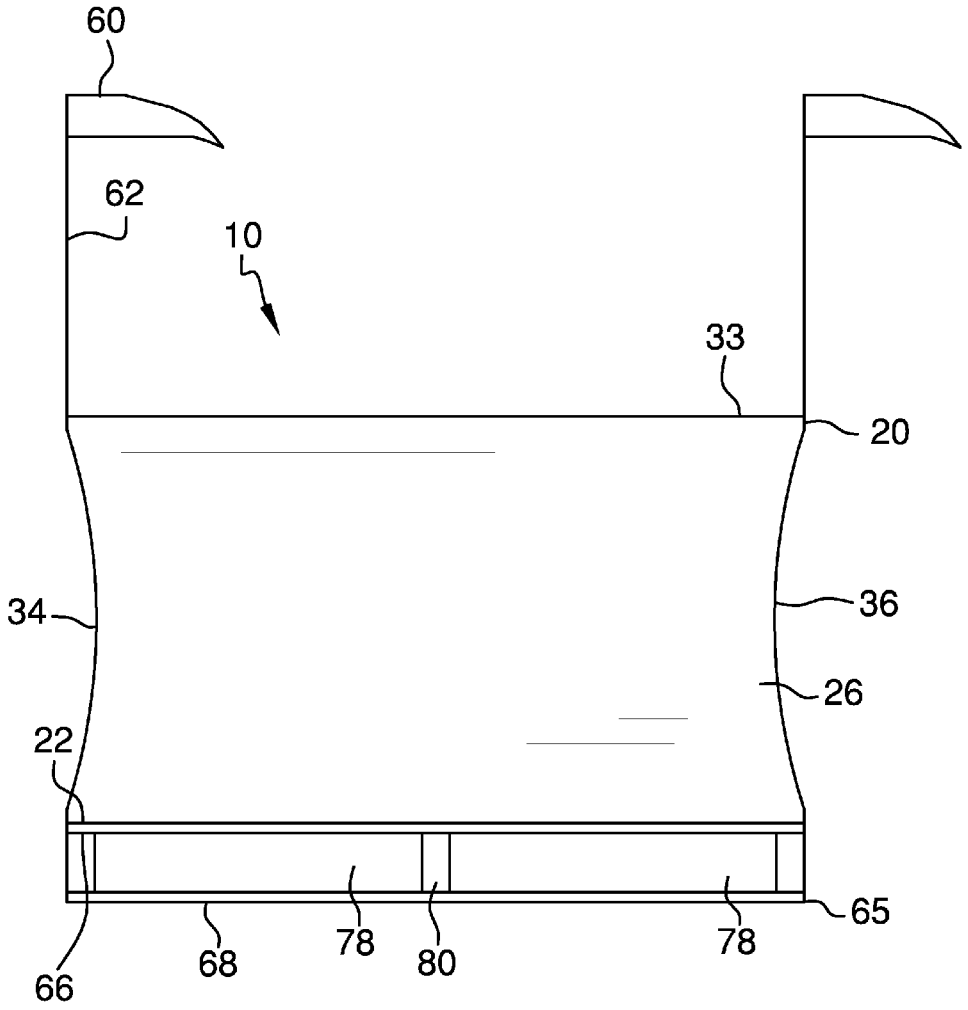
FIG. 4 is a front elevation view including flags.
Figure 5:
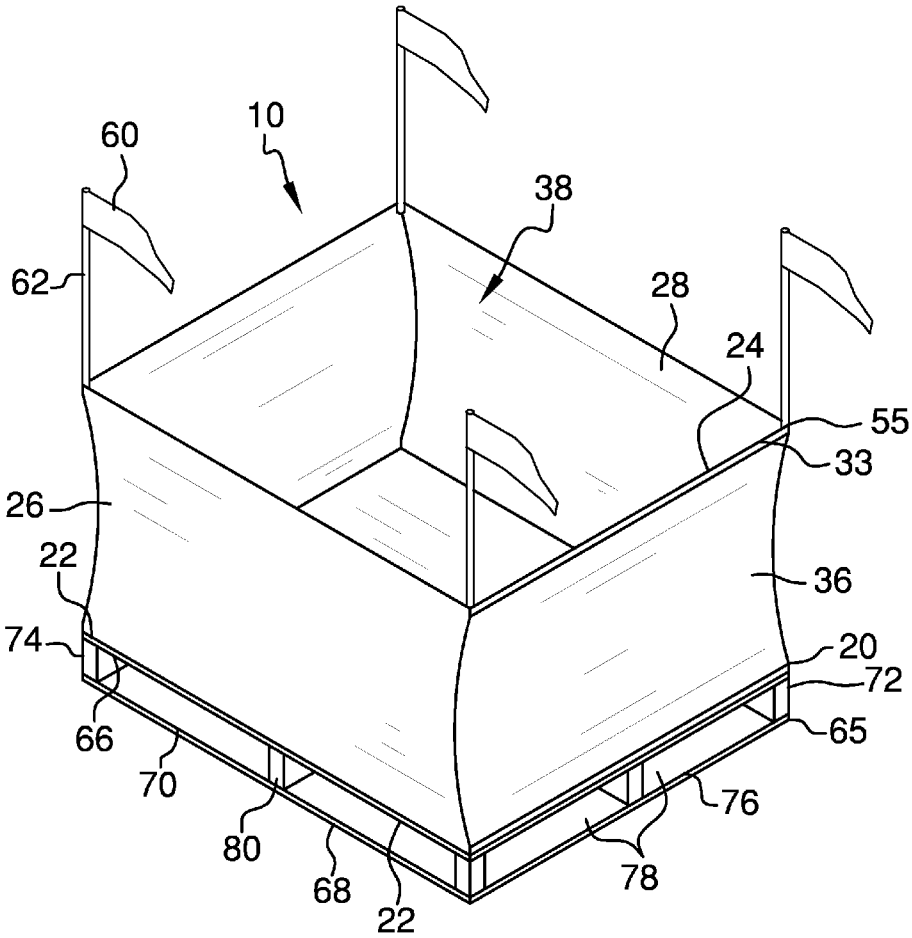
FIG. 5 is a front isometric view of the embodiment of FIG. 4.
Figure 6:
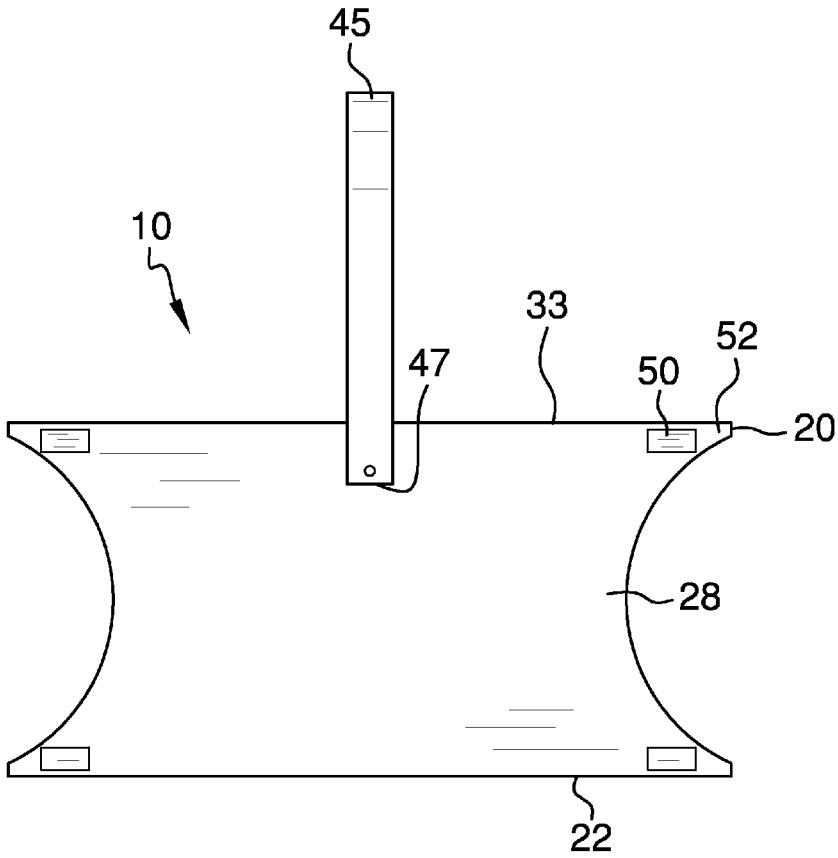
FIG. 6 is a rear elevation view including magnets disposed on a rear side.

With reference now to the drawings, and in particular FIGS. 1 through 6 thereof, example of the instant snow collector device employing the principles and concepts of the present snow collector device and generally designated by the reference number 10 will be described.

Referring to FIGS. 1 through 6, the present snow collector device 10 is illustrated. The snow collector device 10 includes a storage container 20. The storage container 20 has a bottom wall 22 and an opposing open top end 24, as well as a front wall 26 and an opposing rear wall 28. Each of the front wall 26 and the rear wall 28 has a concave first side 30 and an opposing concave second side 32. A continuous perimeter 33 is disposed around the top end 24. The storage container 20 also has a longitudinally concave first wall 34 and an opposing longitudinally concave second wall 36. An internal cavity 38 is disposed between the bottom wall 22, the front wall 26, the rear wall 28, the first side 30 and the second side 32. The concave configuration of the first wall 34 and of the second wall 36 permits an overhang of the perimeter 33 over the first and second walls 34, 36 to reduce the compacting of snow around the storage container 20 which, in turn, makes the lifting of the container easier than with snow compacted around the storage container 20.

An access door 35 is centrally disposed on the front wall 26. A substantially C-shaped cylindrical pull member 37 is disposed on the access door 35 proximal to a top edge 39 of the access door 35. The pull member 37 has a cylindrical cross-member 40 disposed in a position parallel to the access door 35 top edge 39.

The present device 10 also includes an elongated substantially U-shaped strap 45 having opposing outer ends 47. The outer ends 47 are pivotally attached to the respective front wall 26 and rear wall 28. The strap 45 is sturdy and is configured for lifting the storage container 20 when is filled with snow. The pivotal property of the strap 45 allows the strap 45 to be pivoted toward the first side 30 and, alternately, the second side 32 during collection of snow in the internal cavity 38.

The storage container 20 is configured for placement on a ground surface, such as a driveway or a sidewalk, for the collection of snow within the internal cavity 38 of the storage container 20.

The storage container 20 has a height in a range of 15 inches to 24 inches, a length in a range of 18 inches to 36 inches, and a width in a range of 12 inches to 20 inches. The dimensions of the storage container 20 are critical to provide for optimal weight for hand-lifting the storage container 20 filled with snow in order to dispose of snow contained therein.

A plurality of magnets 50 is disposed proximal to each corner 52 of the rear wall 28 to permit the storage container 20 to be secured to a vehicle exterior for the collection of snow before the snow collects on the portion of the vehicle exterior covered by the storage container 20.

In addition, a flag 60 is vertically disposed on each corner 55 of the perimeter 33. The flag 60 has an elongated support post 62. The flag 60 is configured for high visibility in snowy conditions, thus allowing location of the storage container 20, including deep snow conditions, thereby preventing accidental encounters with and damage to the storage container 20 as well as injury to an individual who is unaware of the presence of the storage container 20.

A large version of the present device 10 is mounted to a pallet 65. The pallet 65 has an upper wall 66 continuously attached to the storage container 20 bottom wall 22, a continuous lower wall 68 opposite the upper wall 66, a forward wall 70 and an opposing rearward wall 72 as well as a first side wall 74 and an opposing second side wall 76. Each of the forward wall 70, the rearward wall 72, the first side wall 74, and the second side wall 76 has a pair of openings 78. Each pair of openings 78 is configured with one of the openings 78 disposed on each opposite side of a stud 80 disposed in each of the forward wall 70, the rearward wall 72, the first side wall 74, and the second side wall 76. Each pair of openings 78 is configured to removably receive a pair of forks of a forklift therethrough for lifting the storage container filled with snow and disposing of the snow. The large version of the present device 10, shown in FIGS. 4 and 5, does not require the access door 35. The storage container 20 is configured for placement on a ground surface, such as a parking lot for the collection of snow within the internal cavity 38. The large version of the storage container 20 has a height of approximately 36, a length of approximately 36 inches, and a width of approximately 36 inches.

What is claimed is:

1. A snow collector device comprising:

a storage container comprising:

a bottom wall and an opposing open top end;

a front wall and an opposing rear wall, each of the front wall and the rear wall having a concave first side and an opposing concave second side;

a longitudinally concave first wall and an opposing longitudinally concave second wall;

an internal cavity disposed between the bottom wall, the front wall, the rear wall, the first side and the second side;

a continuous perimeter disposed along the top end;

an access door centrally disposed within the front wall;

a substantially C-shaped cylindrical pull member disposed on the access door proximal to a top edge of the access door, the pull member having a cylindrical cross-member disposed in a position parallel to the access door top edge;

an elongated substantially U-shaped strap having opposing outer ends, wherein the outer ends are pivotally attached to the respective front wall and rear wall; wherein the strap is configured for lifting the storage container;

wherein the storage container is configured for placement on a ground surface, wherein the storage container is configured to collect snow within the internal cavity thereof.

2. The snow collector device of claim 1 wherein the storage container has a height in a range of 15 inches to 24 inches, a length in a range of 18 inches to 36 inches, and a width in a range of 12 inches to 20 inches.

3. A snow collector device comprising:

a storage container comprising:

a bottom wall and an opposing open top end;

a front wall and an opposing rear wall, the rear wall having four corners;

wherein each of the front wall and the rear wall have concave first and second sides;

a longitudinally concave first wall and an opposing longitudinally concave second wall;

an internal cavity disposed between the bottom wall, the front wall, the rear wall, the first side and the second side;

a continuous perimeter disposed along the top end;

an access door centrally disposed within the front wall;

a magnet disposed proximal to each corner of the rear wall;

a substantially C-shaped cylindrical pull member disposed on the access door proximal to a top edge of the access door, the pull member having a cylindrical cross-member disposed in a position parallel to the access door top edge;

an elongated substantially U-shaped strap having opposing outer ends, wherein the outer ends are pivotally attached to the respective front wall and rear wall; wherein the strap is configured to lift the storage container;

wherein the storage container is configured for placement on a vehicle exterior, wherein the storage container is configured to collect snow within the internal cavity thereof.

4. The snow collector device of claim 3 wherein the storage container has a height in a range of 15 inches to 24 inches, a length in a range of 18 inches to 36 inches, and a width in a range of 12 inches to 20 inches.

5. A snow collector device comprising:

a storage container comprising:

a bottom wall and an opposing open top end, the top end having a continuous perimeter therealong;

a front wall and an opposing rear wall, each of the front wall and the rear wall having concave first and second sides;

a longitudinally concave first wall and an opposing longitudinally concave second wall;

an internal cavity disposed between the bottom wall, the front wall, the rear wall, the first side and the second side; and a flag vertically disposed on the perimeter of the storage container top end at each corner thereof, the flag having an elongated support post.

6. The snow collector device of claim 5 further comprising:

a pallet comprising:

an upper wall continuously attached to the storage container bottom wall;

a continuous lower wall opposite the upper wall;

a forward wall and an opposing rearward wall;

a first side wall and an opposing second side wall;

wherein each of the forward wall, the rearward wall, the first side wall, and the second side wall has a pair of openings, wherein each pair of openings is configured with one of the openings disposed on each opposite side of a stud disposed in each of the forward wall, the rearward wall, the first side wall, and the second side wall.

7. The snow collector device of claim 6 wherein the storage container is configured for placement on a ground surface, wherein the storage container is configured to collect snow within the internal cavity thereof;

wherein each pair of openings is configured to removably receive a pair of forks of a forklift therethrough.

8. The snow collector device of claim 7 wherein the storage container has a height of approximately 36 inches, a length of approximately 36 inches, and a width of approximately 36 inches.

9. The snow collector device of claim 8 wherein the flag is configured for high visibility in snowy conditions.

* * * * *